US009857119B2

(12) United States Patent
Keenan

(10) Patent No.: US 9,857,119 B2
(45) Date of Patent: Jan. 2, 2018

(54) INSULATED SEAT COOLER WITH VENTED BACKREST AND OPTIONAL AIR INTAKE AND CIRCULATION SYSTEM

(71) Applicant: Thomas Keenan, Elgin, IL (US)

(72) Inventor: Thomas Keenan, Elgin, IL (US)

( * ) Notice: Subject to any disclaimer, the term of this patent is extended or adjusted under 35 U.S.C. 154(b) by 236 days.

(21) Appl. No.: 14/325,274

(22) Filed: Jul. 7, 2014

(65) Prior Publication Data

US 2015/0007603 A1 Jan. 8, 2015

Related U.S. Application Data

(60) Provisional application No. 61/957,547, filed on Jul. 8, 2013.

(51) Int. Cl.

| | |
|---|---|
| ***F25D 17/04*** | (2006.01) |
| ***F25D 17/06*** | (2006.01) |
| ***F25D 3/08*** | (2006.01) |

(52) U.S. Cl.

CPC ..... *F25D 3/08* (2013.01); *F25D 2400/38* (2013.01)

(58) Field of Classification Search

CPC ..... F25D 3/06; F25D 3/08; F25D 2400/38; F25D 3/04; A47C 7/72; A47C 7/74

USPC .... 62/404–407, 410–412, 417, 457.1, 457.7, 62/326, 419

See application file for complete search history.

(56) References Cited

U.S. PATENT DOCUMENTS

| | | | | |
|---|---|---|---|---|
| 4,141,585 | A * | 2/1979 | Blackman | A47C 7/74 297/180.14 |
| 4,846,493 | A | 7/1989 | Mason | |
| 5,269,157 | A * | 12/1993 | Ciminelli et al. | 62/457.7 |
| 5,275,018 | A * | 1/1994 | Lin et al. | 62/457.7 |
| 5,613,371 | A | 3/1997 | Nelson | |
| 5,660,296 | A | 8/1997 | Greenwich | |
| 5,727,844 | A * | 3/1998 | O'Quinn et al. | 297/217.1 |
| 6,336,341 | B1 | 1/2002 | McGraw et al. | |
| 6,341,817 | B1 | 1/2002 | Stern-Gonzalez | |
| 6,497,424 | B2 | 12/2002 | Gartner et al. | |
| 6,993,930 | B2 * | 2/2006 | Blackstone | 62/421 |
| 7,066,476 | B2 * | 6/2006 | Elden | 280/37 |
| 7,387,305 | B2 | 6/2008 | Vanderberg et al. | |
| 7,603,875 | B2 | 10/2009 | Carr | |
| 7,604,290 | B1 * | 10/2009 | Giordano | 297/188.1 |
| 7,748,235 | B1 | 7/2010 | Franklin et al. | |
| 7,886,548 | B1 * | 2/2011 | Graves | 62/93 |
| 2003/0094836 | A1 * | 5/2003 | Chen | 297/42 |
| 2004/0025531 | A1 | 2/2004 | Holloman-Hughes et al. | |
| 2006/0021374 | A1 * | 2/2006 | Grisler | F24F 3/1405 62/407 |
| 2006/0032265 | A1 * | 2/2006 | Shaw | B60N 2/5621 62/420 |
| 2006/0261654 | A1 * | 11/2006 | Stallman | 297/310 |
| 2007/0193297 | A1 * | 8/2007 | Wilson | 62/371 |

* cited by examiner

*Primary Examiner* — Joseph Trpisovsky
(74) *Attorney, Agent, or Firm* — Wendy Thai

(57) ABSTRACT

The invention provides a cooling apparatus with vented backrest and an optional air intake and circulation system for dual functioning as (1) a cooler effective to maintain food and beverages below ambient temperatures and (2) a seat with vented backrest that provides cooled air to the individual seated on the apparatus.

23 Claims, 10 Drawing Sheets

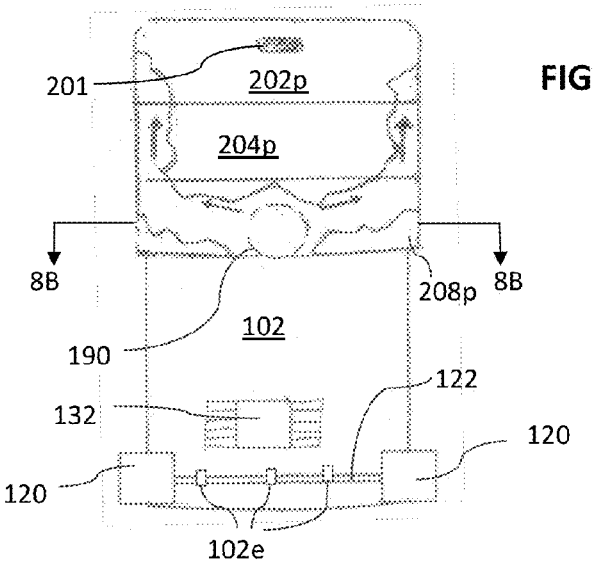
FIGURE 8A
FIGURE 8B
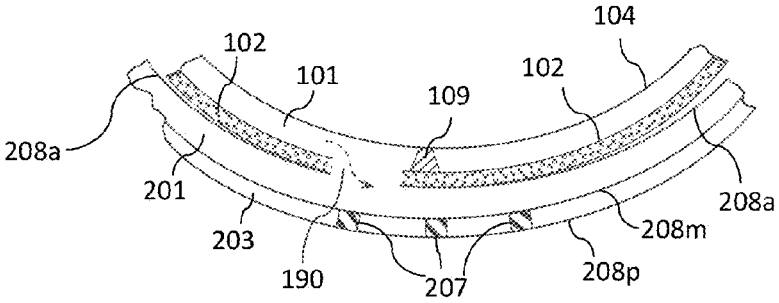
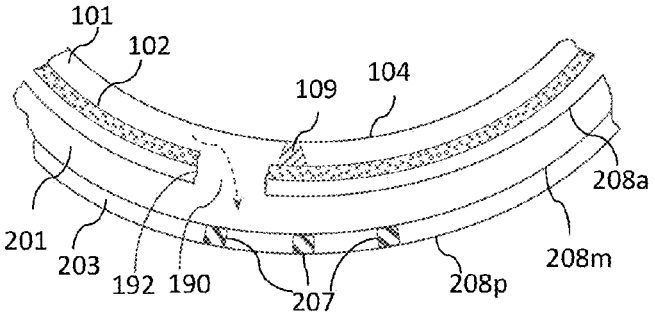
FIGURE 8C

FIGURE 9A
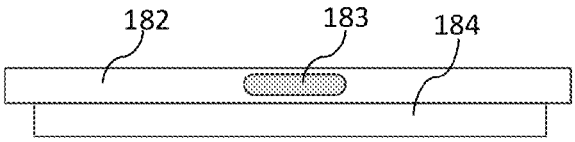
FIGURE 9B
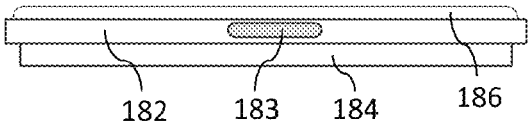
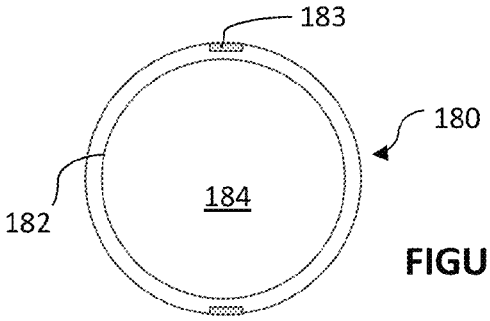
FIGURE 9C
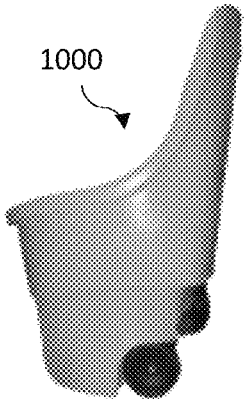
Figure 10A
Figure 10B
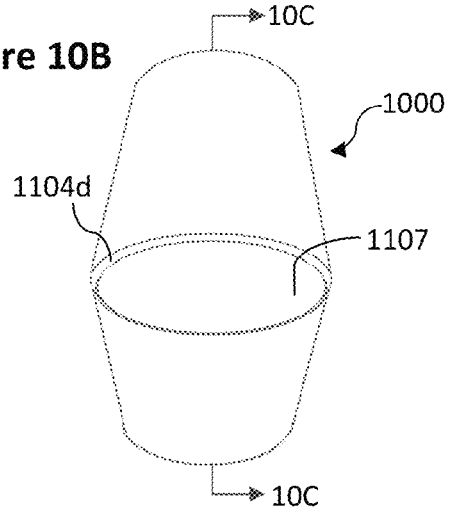
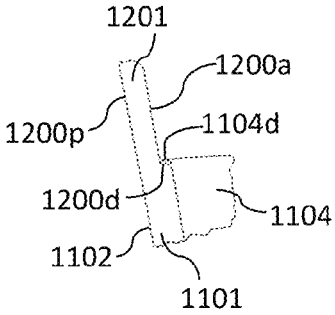
Figure 10C

INSULATED SEAT COOLER WITH VENTED BACKREST AND OPTIONAL AIR INTAKE AND CIRCULATION SYSTEM

CROSS REFERENCE TO RELATED APPLICATIONS

This application claims priority to U.S. provisional application No. 61/957,547, filed Jul. 8, 2013, the contents of which are incorporated by reference in their entirety.

BACKGROUND

Coolers for maintaining food and beverages at low temperatures are often used outdoors during warm seasons when environment temperatures can be greater than is desired or comfortable. They are also frequently used at outdoor activities at venues that provide few accommodations for the attendees and participants.

SUMMARY

The invention provides a cooling apparatus configured with a vented backrest and an optional air intake and circulation system and that can function as (1) a cooler effective to maintain food and beverages at select temperatures and (2) a seat with vented backrest that provides cooled air to a person seated on the apparatus.

The invention provides a cooling apparatus that includes an insulated cooler coupled to a vented backrest. The insulated cooler includes an outer shell, an inner thermal insert and a first air space therebetween, the vented backrest includes an anterior panel adjoining a posterior panel through side panels to form a second air space therebetween, and the first air space and second air space being in communication to enable airflow therebetween. The cooling apparatus also includes a first opening in the outer shell of the cooler portion for airflow between the exterior of the cooler and the first air space, and one or more vents in the backrest portion for air flow between the second air space and the exterior of the apparatus.

In some embodiments of the invention, the cooling apparatus also includes a cover plate configured to fit at the first opening to close access.

In some embodiments of the invention, the outer shell and inner thermal insert of the cooler form a cooler housing that includes a bottom and lateral wall, the bottom having a curved peripheral edge from which the lateral wall extends upwardly to form a storage chamber. In some embodiments, the storage chamber is accessible through a top opening fitted with a similarly insulated lid, the cooler housing and lid cooperating to form a seat effective to support a person. In some embodiments, the lid includes a cushion on which a person can be seated. In some embodiments of the invention, the cooling apparatus also includes an exterior wheel-axle assembly affixed to the cooler at a lower posterior position to enable towing of the cooling apparatus, and wherein the backrest comprises an integrated towing handle for towing the apparatus. In some embodiments, the wheel-axle assembly includes two wheels affixed at an elevated position relative to the bottom of the cooler so as to be positioned above the surface on which the bottom of the cooler rests and contacts the surface when the apparatus is tilted posteriorly.

In some embodiments of the invention, the outer shell of the cooler housing includes closed cell foam insulation disposed between an outer wall panel and an inner wall panel.

In some embodiments of the invention, the outer wall panel, inner wall panel, or both outer and inner wall panels includes stainless steel, polyethylene, polypropylene, polystyrene or any combination thereof. In some embodiments, the inner lining includes a metal or a thermally conductive plastic.

In some embodiments of the invention, airflow between the first and second air spaces of the cooling apparatus occurs through openings on the opposing surfaces of the outer shell of the cooler and anterior panel of the backrest that are in alignment, and wherein portions of the opposing surfaces that comprise the openings are in direct contact.

In some embodiments of the invention, airflow between the first and second air spaces of the cooling apparatus occurs through openings in the cooler housing and backrest that is fitted with a rigid or flexible duct or gasketing material.

In some embodiments of the invention, the backrest includes two or more telescopic sections that are retractable one within another to enable the backrest to be collapsed for stowing or extendable to form a back support for a person seated on the cooler. In some embodiments, the sections are reinforced using one or more internal structural ribbings, each of which has two or more telescopic segments that can be collapsed or extended to collapse or extend the backrest.

In some embodiments of the invention, the backrest and cooler are integrally molded.

In some embodiments of the invention, the cooling apparatus has one or more vents disposed in the anterior panel, side panels or both anterior and side panels for the egress of air from the second air space to the exterior of the apparatus.

In some embodiments of the invention, the cooling apparatus further includes an air intake assembly disposed at the first opening for drawing air from the exterior of the cooler to the first air space, the air intake assembly including a fan for blowing air into the first air space, a power source for supplying power to the fan, and a switch for controlling power to the fan, wherein the fan, power source and switch are electrically connected so as to allow the switch to control power to the fan thereby allowing the fan to be turned on or off using the switch. In some embodiments, the power source is a rechargeable battery. In some embodiments, the air intake assembly further includes an AC adapter port electrically connected to the rechargeable battery so as to enable the battery to be charged. In some embodiments, the air intake assembly further includes a 12 V DC automotive plugin adapter.

Any feature or combination of features described herein are included within the scope of the present invention provided that the features included in any such combination are not mutually inconsistent as will be apparent from the context, this specification and the knowledge of one of ordinary skill in the art.

Unless otherwise defined, all technical and scientific terms used herein have the same meaning as commonly understood by one of ordinary skill in the art to which this invention belongs. In case of conflict, the present specification, including definitions, will control. In addition, the materials, methods, and examples are illustrative only and not intended to be limiting. Although methods and materials similar or equivalent to those described herein can be used to practice the invention, suitable methods and materials are described below.

All patents and publications referenced or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

Other features and advantages of the invention will be apparent from the following detailed description and from the claims.

DESCRIPTION OF THE DRAWINGS

FIGS. 8A-8C are three views of backrest 200 that illustrate the path of airflow to backrest 200 including: a rear view of cooling apparatus 1 in which the mid- and posterior panels of backrest 200 are partially removed to illustrate opening 190 through which air enters anterior chamber 201 of backrest 200 from cooler 100 (bold arrows indicate subsequent air movement through anterior chamber 201) (8A); and cross-sectional views along line 8B-8B illustrating the opening for airflow from cooler 100 to backrest 200 in two embodiments of the invention (8B & 8C).

FIGS. 9A-9C are three views of lid 180 for cooler housing 100 including a side view (9A), a side view of lid 180 fitted with seat cushion 186 (9B), and a view from the underside (9C).

FIGS. 10A-10C are three views of cooling apparatus 1000 integrally formed with a vented backrest including a side view (10A), a front view (10B) and a partial view of the vertical cross-section along line 10C-10C of FIG. 10B (10C).

DETAILED DESCRIPTION

Figure 1:
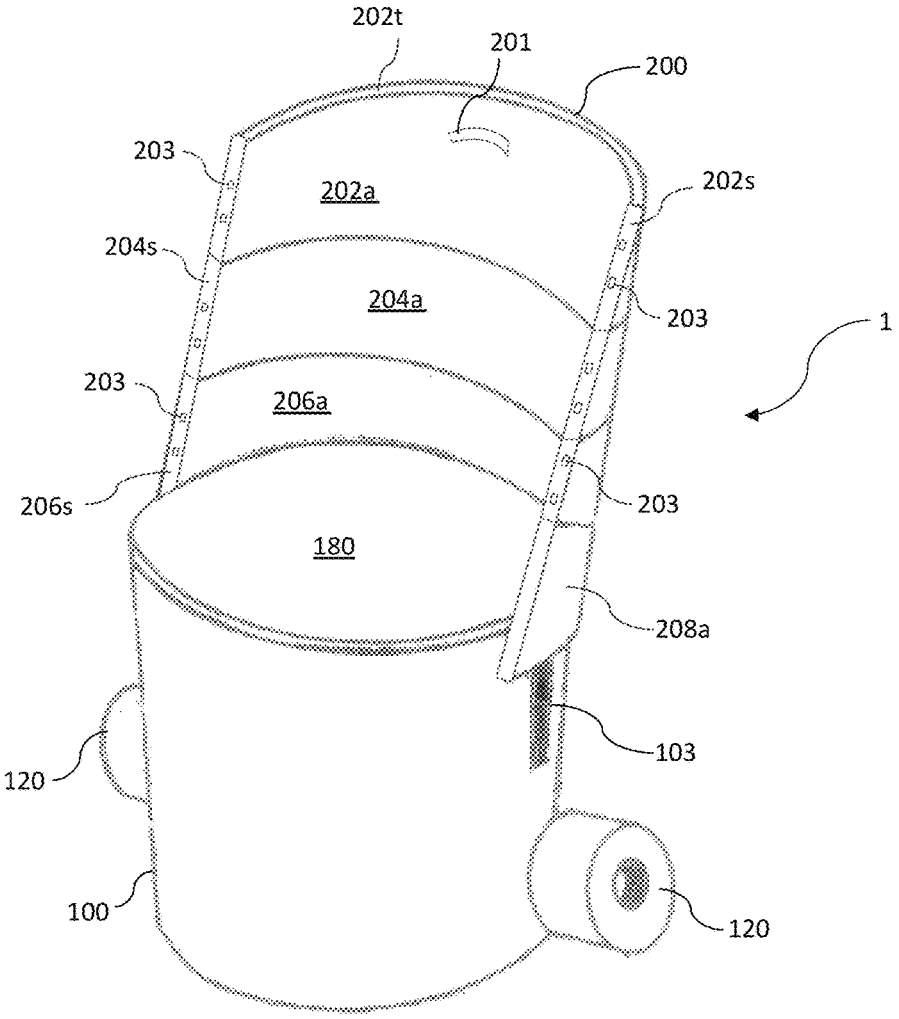
FIG. 1 is a front perspective view of a seat cooler with cooler portion 100, lid 180 and telescopic backrest 200 in the fully extended position.

The invention provides a cooling apparatus configured with a vented backrest and an optional air intake and circulation system and that can function as (1) a cooler effective to maintain food and beverages at select temperatures and (2) a seat with vented backrest that provides cooled air to a person seated on the apparatus.

A cooling apparatus of the invention includes a cooler and attached vented backrest. The cooler has a structure that includes a bottom, lateral walls extending upward from the peripheral edge of the bottom thereby forming a storage chamber with a top opening and a lid fitted to the opening for closing access to the storage chamber. The backrest can be integrally molded to the cooler or attached to the cooler at one or more attachment points and can have a telescopic structure that enable it to be collapsed for stowing.

The cooler can have any convenient shape including cylindrical, square, or rectangular. The cooler can have a regular or irregular shape. For example, the base or bottom and/or top of the cooler can have a circular, elliptical, oval, square, rectangular, trapezoidal or any other regular or irregular shaped footprint as convenient for use as a cooler and or seat. The lateral wall can extend directly upward from the peripheral edge of the base of the cooler or extend upwardly in an angle to form a storage chamber that widens towards the top of the cooler. For example, where the cooler has a circular bottom, the cooler can have a structure similar to a hollow cylinder or a frusto-conical structure in which the top is wider than the bottom of the cooler. The cooler includes a removable lid that is fitted to the top opening to close access to the inner storage chamber. The lid can be constructed to function as a seat. For example, the lid can be constructed with a cushion, pad or other softer material on its outer surface to provide a comfortable support for sitting.

The cooler housing includes an insulated outer shell and a removable, inner thermal insert. The insulated outer shell can be constructed using methods and materials known to those of skilled in the art in the construction of cooler housings. The insulated outer shell can have a double-walled construction that includes an outer wall panel and an inner wall panel with insulation therebetween. The outer and inner wall panels of the insulated outer shell as well as insulation can be of any materials known to those of skill in the art. For example, the outer and inner wall panels can be composed of any material known to those of skill in the art for constructing coolers including metal such as steel, for example, stainless steel, as well as plastics such as polyethylene (PE), for example, high-density polyethylene (PE), polypropylene (PP), or polystyrene (PS), and the insulation can be foams such as polystyrene, e.g. molded expanded polystyrene (MEPS) and extruded expanded polystyrene (XEPS), polyurethane, and polyisocyanurate.

The thermal insert can be composed of any material effective for thermal transference or having high thermal conductivity including a metal such as brass, aluminum, copper, steel, cast iron, cobalt, as well as plastics such as thermally conductive plastic or any combination thereof. The thermal insert has a structure or shape substantially similar to the outer shell and generally has smaller dimensions so as to fit into the hollow center of the outer shell to form an air space between the outer shell and inner thermal insert. For example, a cylindrical outer shell can be fitted with a similarly cylindrical thermal insert that has a smaller bottom diameter and/or top opening diameter relative to that of the outer shell to enable the thermal insert to fit within the hollow center of the insulated outer shell so as to form a cooler housing with an air space between the outer shell and inner thermal insert. Similarly, a frusto-conical outer shell can be fitted with a similarly frusto-conical thermal insert having a smaller bottom diameter and/or top opening diameter to enable the thermal insert to fit within the hollow center cavity of the outer shell so as to form a cooler housing with an air space between the outer shell and inner thermal insert. The thermal insert can include two or more tabs, protrusions or appendages at the bottom of the insert that contact the bottom of the outer shell when the insert is placed into the hollow outer shell thereby raising the bottom of the thermal insert above the bottom of the outer shell and extending the air space between the lateral walls of the thermal insert and outer shell to between the bottoms of the thermal insert and outer shell. As such, the insulated outer shell and thermal insert together form a cooler housing having a storage chamber within which food, beverage, ice, ice replacements or the like, and any combination thereof can be placed, as well as an air space surrounding the storage chamber that can be maintained at a temperature substantially similar to the temperature of the storage chamber through thermal transference across the metal thermal insert. The later allowing air circulated through the air space between the outer shell and thermal insert of the cooler housing to be cooled.

The backrest can have any convenient shape that can provide back support to a person seated on the lid of the cooler. The anterior or front of the backrest can have a concave structure to receive the back of a person seated on the cooler. The backrest can reclined or angled rearwardly, for example, about 100 degrees to about 110 degrees for increased comfort and/or ease of stowing. The backrest can be reclined at about 101 degrees, 102 degrees, 103 degrees, 104 degrees, 105 degrees, 106 degrees, 107 degrees, 108 degrees, 109 degrees or 110 degrees, for example.

The backrest is constructed with an anterior or front panel and adjoining a posterior or rear panel through side panels and one or more air vents as further described herein. The anterior panel can have a concaved outer surface to receive the back of a person seated on the cooler, and the posterior panel can have a similar structure with a convex outer surface. The backrest can optionally be constructed with an inner panel disposed between the anterior and posterior panels so as to form an anterior chamber and a posterior chamber. Where the backrest includes an inner panel forming anterior and posterior chambers, the anterior chamber can be in communication with the air space in the cooler housing thereby receiving cooled air from the air space within the cooler housing. The anterior and/or side panels can include one or more air vents positioned as convenient for the egress of air from the anterior chamber to the space surrounding the backrest so as to provide cooled air to the external space in proximity to the cooler and backrest.

The backrest can be constructed one or more structural ribbing extending substantially the height of the backrest so as to provide added strength. The structural ribbing can be disposed between the anterior and posterior panels, for example, in the posterior chamber between the inner panel and posterior panel of the backrest. The structural ribbing can be attached to the inner panel or, in the absence of the inner panel, attached to the posterior panel to reinforce the strength of the backrest.

The backrest can be integrally molded with the cooler or coupled to the cooler by attachment at two or more discrete positions using means known to those of skill in the art. For example, the backrest can be attached to the sides of the cooler through one or more gliding or ball-an-socket joints between the cooler and backrest. For example, the first surface can be configured with a vertical slot or groove effective to receive a protrusion on the opposing surface thereby allowing the opposing surfaces to be attached in a slidable manner. Where the backrest is attached to the cooler at two or more discrete positions, cooled air from the air space in the cooler housing can be directed to the air space in the backrest by alignment of openings on opposing surfaces of the outer shell of the cooler and anterior panel of the backrest. The aligned openings can be in closed proximity, for example, portions of the outer shell of the cooler and anterior panel of the backrest that surround the openings can be in contact thereby allowing airflow directly from the air space in the cooler to the air space in the backrest through the openings. Alternatively, where the surfaces are not in contact, for example, where a gap exists between opposing surfaces surrounding openings, rigid or flexible ducting or gasketing can be used between openings in the outer shell of the cooler and anterior panel of the backrest. The openings can be positioned to as to be in alignment and/or in close proximity so as to minimize the length of any ducting or amount of gasketing needed. Where ducting or gasketing is used, any rigid or flexible ducting or similar materials known to those of skill in the art can be used. Non-limiting examples include metal ducts, fiberglass ducts, flexible ducts, fabric ducts, a gasketing material, or any combination thereof for bridging an opening in the outer shell and the opposing opening in the anterior backrest panel for the egress and ingress of air respectively from the cooler to backrest. In general, attachment components and/or ducting are disposed between and/or join opposing surfaces of the backrest and cooler housing, for example, the exterior surface of the outer shell at the side or posterior of the cooler and the exterior surface of the anterior panel of the backrest.

Where the backrest is integrally molded with the cooler housing, for example, cooling apparatus 1000 illustrated in FIG. 10A & 10B, the posterior panel of the backrest can be integrally molded with the outer shell of the cooler, while the anterior panel of the backrest can extend downwardly terminating just below the upper edge of the cooler, i.e. below its opening. As such, the cooler, as well as lower edge of the anterior panel of the back rest can include an inner lip with which the outer peripheral flange of the thermal insert contacts in overlapping configuration (see, for example, component 1104*d,* FIG. 10B) to form a closed air space between the thermal insert and outer shell of the cooler. FIG. 10A-10C for example, illustrates cooling apparatus 1000 in which the backrest is integrally molded with the cooler housing. More specifically, a vertical cross-section of a portion of cooling apparatus 1000 along line 10C-10C of FIG. 10B shows that posterior panel 1200*p* of backrest is contiguous with outer shell 1102 of cooler, while anterior panel 1200*a* extends downwardly terminating in lip 1200*d*, with which outer peripheral flange 1104*d* of thermal insert 1104 contacts in overlapping configuration (FIG. 10C). As such, air space 1101 between outer shell 1102 and thermal insert 1104 is contiguous with air space 1201 between the anterior panel 1200*a* and posterior panel 1200*p* of backrest.

Where the backrest has a telescopic structure that allows it to collapse when not in use, the backrest can have a shape and/or outer contour that aligns with posterior lateral contour of the cooler thereby allowing the backrest to hug the posterior lateral surface of the cooler when in stowed position. Where the backrest is telescopic, the backrest can be composed of two or more progressively smaller sections-each composed of an anterior panel adjoining a posterior panel through side panels-that can be nested one within another thereby enabling the backrest to be collapsed or extended as needed. In these embodiments, the lowest backrest section also includes a bottom panel to which the lower edge of an inner panel is securely attached, and the highest backrest section includes a top panel to which the upper edge of an inner panel is attached. As such, the extension or retraction of each progressively smaller backrest sections can be achieved using telescopic structural ribbings that are configured with a locking system to maintain position when fully extended. As the telescopic structural ribbings with locking system are securely attached to, or integrally molded with, the inner panels, the highest and lowest of which are securely fastened to the highest and lowest sections of the backrest, the backrest sections and inner panels with structural ribbings function telescopically as a unit that can be collapsed for stowing or fully extended and maintained in the extended position through the locking mechanism on the structural ribbings. Any telescopic locking systems well known to those of skill in the art including, without limitation, pin locks can be used.

The cooler and backrest can be of any convenient size or dimension. Similarly, the outer shell, insulation, outer and inner wall panels of the outer shell, thermal insert as well as the anterior, posterior and inner panels of the backrest can be of any convenient size or thickness as known to those of skill in the art.

A cooling apparatus of the invention can include housing opening in the outer shell of the cooler effective to accommodate an optional battery-powered air intake assembly for drawing air into the air space within the cooler housing. A cooling apparatus of the invention can include a cover for the air intake assembly housing opening that can be of similar construction as the outer shell. The cover can be secured to the housing opening when a battery powered air intake assembly is not mounted in the cooling apparatus. The battery-powered air intake assembly can include one or more air intake vents, filters for filtering external air, a fan or blower for blowing air into the air space of the cooler housing, ducting as needed to provide air passage, a battery for powering the fan, as well as adaptors effective to receive external sources of power. Fans, filters, batteries, as well as adaptors and rocker switches are well known to those of skill in the art and can be purchased from a variety of sources. More specifically, any fan or blower capable of blow air into the air space in the cooler housing can be used including DC axial fans having an output of, for example and without limitation, 30 cubic feet per minute (CFM), 40 CFM, 50 CFM, 60 CFM, 70 CFM or 20 more than 70 CFM can be used in an air intake assembly of the invention. Examples of fans that can be used include DC axial fan model 4715KL-04W-B50 and BG1203-B045-000 provided by NMBTechnologies Corporation (see NMBTC.com). Non-limiting examples of a battery, adapter and rocker switch that can be used in an apparatus of the invention include the Black & Decker PS130 power pack and charger, which can be purchased from any home center or hardware store, and the Memory Protection Devices ZA 5077 and Aspen Inc. KG472A2XXA21XY rocker switch from Digi-Key Corporation.

The air intake assembly housing can be disposed at any convenient location on the cooler, for example in the rear, side or front of the cooler. Preferably, the air intake assembly housing is disposed at the rear of the cooler adjacent to a partition in the air space of the cooler housing so as to enable the uni-directional movement of air around the body of the cooler for maximal cooling. A cooler of the invention can include an airflow partition disposed in the air space within the cooler housing in the immediate left or right vicinity of a first opening in the outer shell for entry of air into the air space from the optional air intake assembly. As such, air is directed around the cooler to the other side of the partition where it exits through a second opening in the outer shell and enters the backrest. Thus, in general, an airflow partition can be positioned between two openings, one for the entry of air into the air space in the cooler housing and the second for the egress of cooled air from the cooler housing to the backrest.

The invention is described in more detailed below with reference to the accompanying drawings that illustrating particular embodiments of the invention. The following examples illustrate specific embodiments of the invention and do not limit the scope of the invention described in the claims.

EXAMPLES

FIG. 1 provides a front perspective view of cooling apparatus 1, a round-shape insulated cooler with towing wheels and a telescopic, concaved-shape backrest that is angled rearwardly so as to provide a comfortable support for a person seated on the cooler. Cooling apparatus 1 includes a cooler with a storage chamber for food, beverages, ice or any combination thereof and a round, removable insulated lid for the cooler that has recessed grips for easy removal and also functions as a seat. The body of the cooling apparatus includes an opening on the outer shell that allows external air to be inducted by an optional battery-powered fan through an air space between walls of the cooler housing. Air from the cooler housing flows through additional ducting up and around concaved backrest and exits through air vents strategically positioned on concaved backrest to cool the torso of the person sitting on the cooler. The optional battery-powered fan can be disposed at the opening to blow air into an air chamber within the walls of the cooler housing and backrest. The cooling apparatus includes wheels that allow the apparatus to be rolled over various terrains with minimal effort and reduced chance of tipping.

In cooling apparatus 1, telescopic backrest 200 is shown in a fully extended position and is attached to cooler 100 through guide 103, vertically-oriented grooves on either side of cooler 100. Backrest 200 includes four sections, in particular, section 202, 204, 206 and 208, which operate in a telescopic manner to allow backrest 200 to be fully extended or maintained in a collapsed or stowed position. Uppermost section 202 is configured with towing handle 201 having a lock-release that when depressed, allow section 202 to retract into the body cavity of section 204, section 204 to retract into the body cavity of section 206, and section 206 to retract into the body cavity of section 208 when the user presses the sections downwardly. By collapsing backrest 200, the cooling apparatus can be easily stored for transport or storage in a compact form. Wheels 120 on lower posterior portion of cooler and towing handle 201 on backrest facilitate towing of cooling apparatus 1. Cooling apparatus 1 is fitted with cooler lid 180, a round removable insulated lid with recessed grips for easy removal that cooperates with cooler 100 to support a person seated on lid 180. The top, exposed surface of lid 180 can include a cushion to increase comfort for the seated individual. The inner chamber of insulated cooler 100 can be used to hold food, beverage, ice or any combination thereof.

Figure 2B:
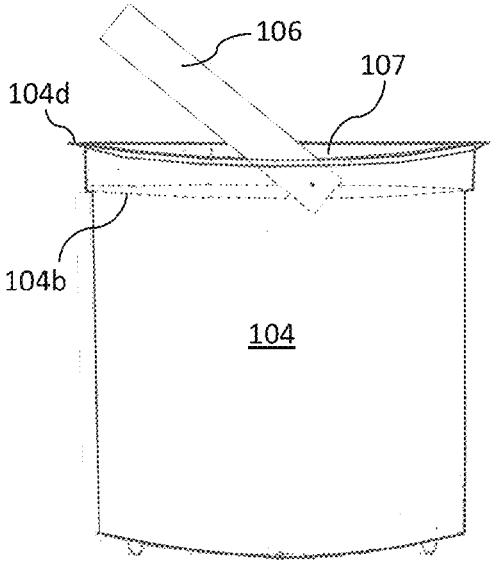
FIGS. 2A-2C are three views of components of cooler portion 100 including: a side perspective view of thermal insert 104 that fit within inner cavity 101 of insulated housing 102 (2A); a bottom view of thermal insert 104 with tabs 108 (2B); and a cross-sectional view from above of insulated housing 102 with outer shell 102*a*, foam insulation 102*b* and inner shell 102*c* (2C).
Figure 2B:
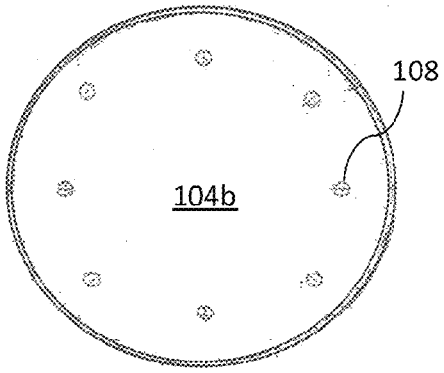
Figure 2A:
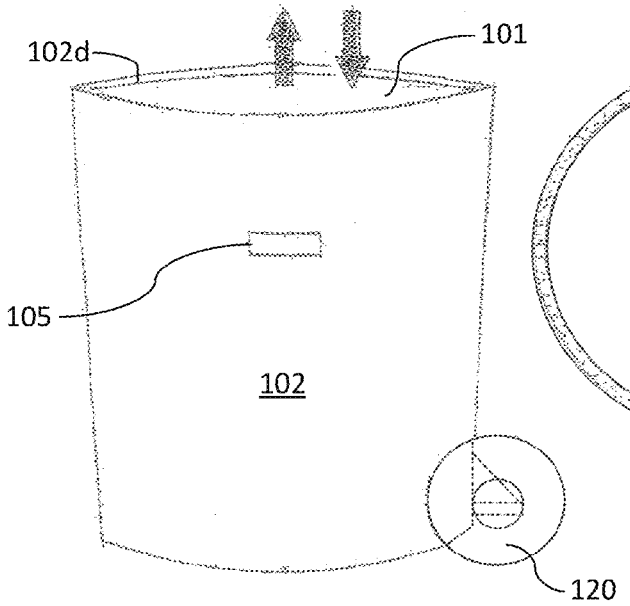
Figure 2C:
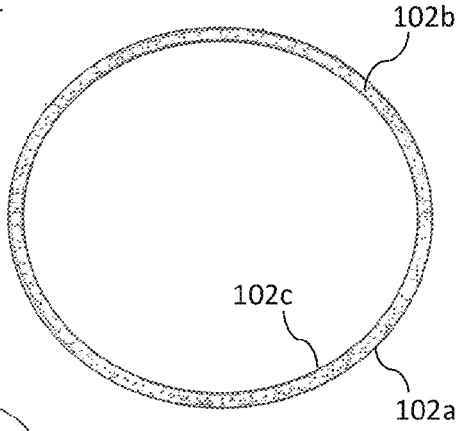

Components forming the cooler housing are illustrated in FIGS. 2A-2C and include insulated outer shell 102 and thermal insert 104. Insulated outer shell 102 has a bottom with a circular peripheral edge (FIG. 2C) from which a lateral wall extends upwardly to form chamber 101 (FIG. 2A). Outer shell 102 also has recessed grip 105 for ease of handling and removable, and an inner lip 102*d* on which the outer peripheral flange of thermal insert 104 rests (FIG. 2A).

Insert 104 has a similar shape and includes a bottom with a circular peripheral edge from which its lateral wall extends upwardly (FIG. 2B). Insert 104 has a narrower cross-sectional diameter and shorter lateral wall relative to outer shell 102, thereby allowing insert 104 to fit within chamber 101 to form narrow air space 101 between the lateral walls of outer shell 102 and insert 104. Insert 104 also includes a plurality of tabs 108 on its underside (FIG. 2B) that function to raise the bottom of insert 104 relative to the bottom of outer shell 102 thereby extending air space 101 to include the space between the bottoms of insert 104 and outer shell 102.

Insert 104 is a removable insert having chamber 107 for holding a variety of items include food and/or beverages, as well as ice for keeping the contents cold. Insert 104 includes curved handle 106 for ease of removal or installation (FIG. 2A). Handle 106 is attached to insert 104 on its inner side and stows flat on inside lip 104*b* to ensure non-interference of handle when stowed. Thermal insert 104 also includes outer peripheral flange 104*d* extending along the upper edge and lays flushed against inner lip 102*d* of outer shell 102 when it is inserted into outer shell 102. Thermal insert 104 is of metal construction to allow complete thermal transference to air space 101 thereby enabling ice stored in chamber 107 to cool the air in space 101. The metal construction of thermal insert 104 and the weight of contents stored in thermal insert 104 ensure good contact between outer peripheral flange 104*d* and inner lip 102*d* of outer shell 102 so as to minimize air leakage from air space 101.

Figure 3A:
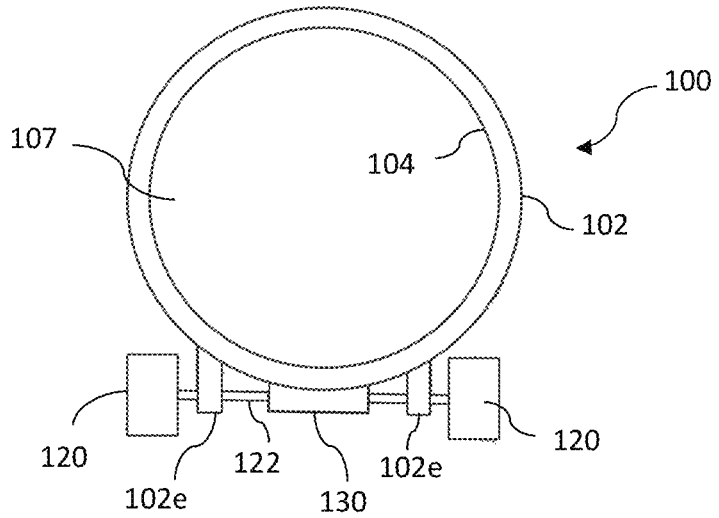
FIGS. 3A-3B are two views of cooler housing 100 including: a top view showing positions of insulated housing 102, thermal insert 104, housing opening 130 and wheels 120 with axel 122 (3A); and enlarged cross-sectional views of the circular cooler housing showing thermal insert 104 with storage chamber 107, air space 101, and the three layers of insulated housing 102 (3B).
Figure 3B:
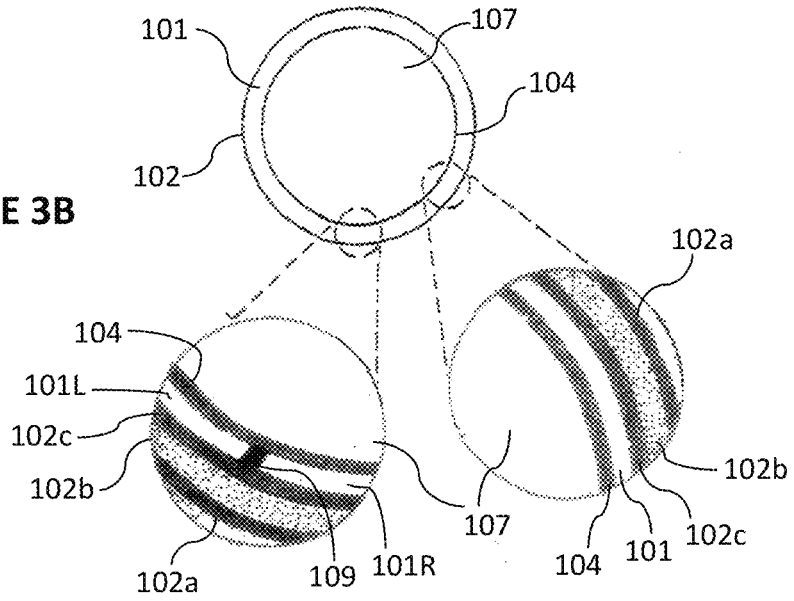
Figure 4A:
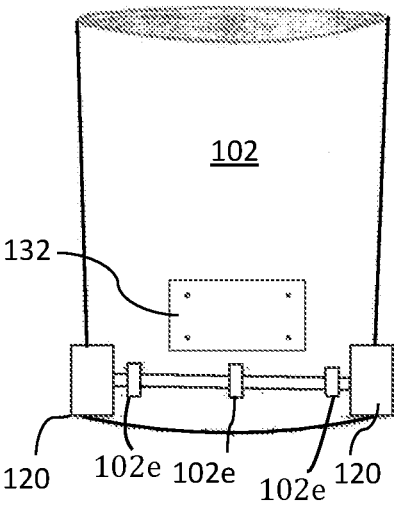
FIGS. 4A-4C are three views of the cooler housing 100 including: a rear view (4A) and a side view (4B) of cooler housing 100, as well as a perspective view of the posterior lower portion of cooler housing 100 illustrating the wheel-axle assembly attached to cooler housing 100 through attachment means 102*e* (4C).
Figure 4B:
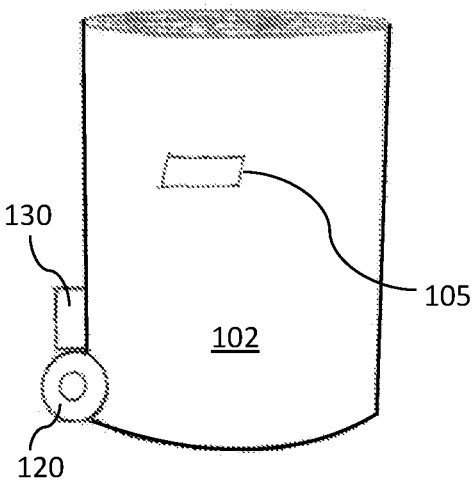

FIGS. 3A-3B provide two views of cooler housing. A top view of cooler 100, shown without lid 180 and backrest 200, is provided in FIG. 3A. The cooler housing includes outer shell 102 and insert 104 with storage chamber 107. A wheel-axle assembly is secured to the rear of cooler 100 through attachment means 102*e*. The wheel-axle assembly includes support axle 122 and attached cooler wheels 120 that enable towing of the cooling apparatus. An optional air intake assembly can be mounted at housing opening 130 located at the posterior side of the cooler housing above the wheel-axle assembly (FIG. 3A, see also FIGS. 4A & 4B). In general, the air intake assembly can be at any convenient position on the cooler, for example, at a side position or at an anterior position.

Figure 6A:
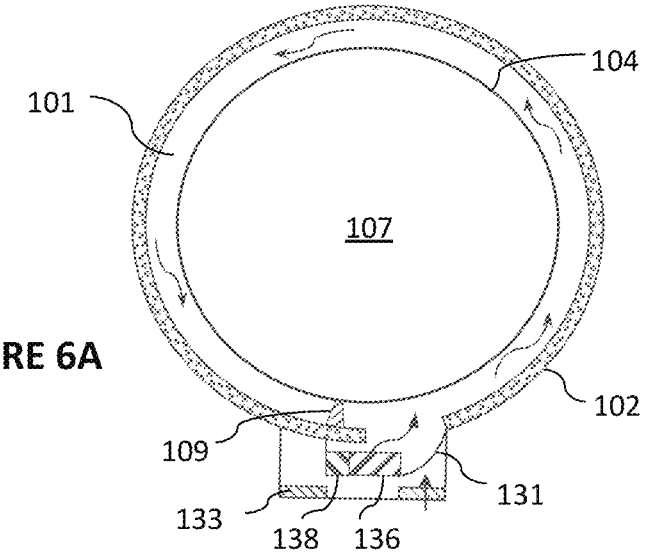
FIGS. 6A-6B are two views of cooler portion 100 including a cross-sectional view (6A) and a front perspective view with partial cut out of insulated housing 102 (6B) illustrating the path of air movement from intake vents 133 through fan 136 to air space 101.

FIG. 3B provides an exploded view of two portions of a cross-section of cooler 100 illustrating insulated outer shell 102 and thermal insert 104 with air space 101 therebetween. Outer shell 102 includes outer wall panel 102*a*, foam insulation 102*b* and inner wall panel 102*c*. Thus, outer shell 102 is of double wall construction with foam insulation (e.g. closed cell foam insulation) disposed between an outer and an inner wall panel. The outer and inner panels can be composed of any material known to those of skill in the art for constructing coolers including plastics such as polyethylene (PE), for example, high-density polyethylene (PE), polypropylene (PP), or polystyrene (PS). The insulation can be any material known to those in the art for use as an insulator including foams such as polystyrene, e.g. molded expanded polystyrene (MEPS) and extruded expanded polystyrene (XEPS), polyurethane, and polyisocyanurate. The outer and inner wall panel 102*a* and 102*c* can be any convenient thickness, for example, about a quarter inch think, while foam insulation 102*b* can be any convenient thickness, for example, about half an inch thick. Similarly, air space 101 can be any convenient thickness, for example, about an inch thick. Airflow partition 109 is disposed in air space 101 near the center of the posterior portion of the housing and extends from top to bottom of the cooler housing in air space 101. Partition 109 enables airflow within air space 101 in a counter-clockwise direction from an entry point on the right side of partition 109 to the left side of partition 109 thereby maximizing air cooling prior to its exit from the cooler housing on the left side of partition 109 as further discussed below (see also FIGS. 6A, 6B & 8B).

Figure 4C:
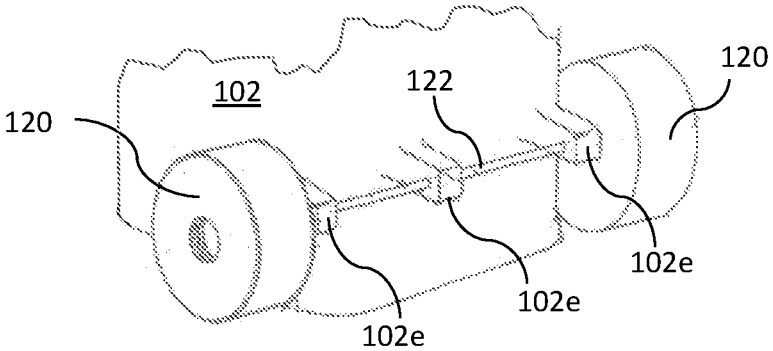

The lower posterior portion of cooling apparatus 1, illustrated in FIGS. 4A-4C, includes housing opening 130 to which removable cover plate 132 is fitted and a wheel-axle assembly for towing cooling apparatus 1. FIGS. 4A and 4B are rear and side views, respectively of cooler 100. In the absence of a battery-powered air intake assembly, removable cover plate 132 is secured to housing opening 130 using one or more fasteners including screws, e.g. steel screws, or snap-fit components as well known to those of skill in the art (FIG. 4A). Removable cover plate 132 is of double wall construction with closed cell foam insulation between the walls. Removable, insulated cover plate 132 can be removed for installation of the optional battery-powered air intake assembly. Where cooling apparatus 1 includes a battery-powered air intake assembly for blowing air into air space 101, the air intake assembly can be mounted on cooler 100 at housing opening 130 (FIG. 4B).

The wheel-axle assembly, which includes wheels 120 and axle 122, is secured to cooler 100 beneath housing opening 130 through three attachment means 102*e* (FIGS. 4A & 4C). The wheel-axle assembly is attached to cooler 100 in an elevated position relative to the bottom of cooler 100 (FIGS. 4A & 4B). As such, wheels 120 are elevated relative to the bottom of cooler 100 and do not touch the surface on which cooler 100 rests when the cooling apparatus is not tilted. When cooling apparatus is tilted posteriorly, wheels 120 contact the surface on which cooling apparatus is placed, thereby allowing the cooling apparatus to be towed. As cooler wheels 120 only contact the ground when being rolled, unintended movement of the cooling apparatus when a person is sitting or about to sit on the cooling apparatus is minimized. The wheel-axle assembly is constructed to support weight loads associated with carrying fully loaded wheeled cooler and any additional weight associated with carrying one or more items on the seat.

Figure 5:
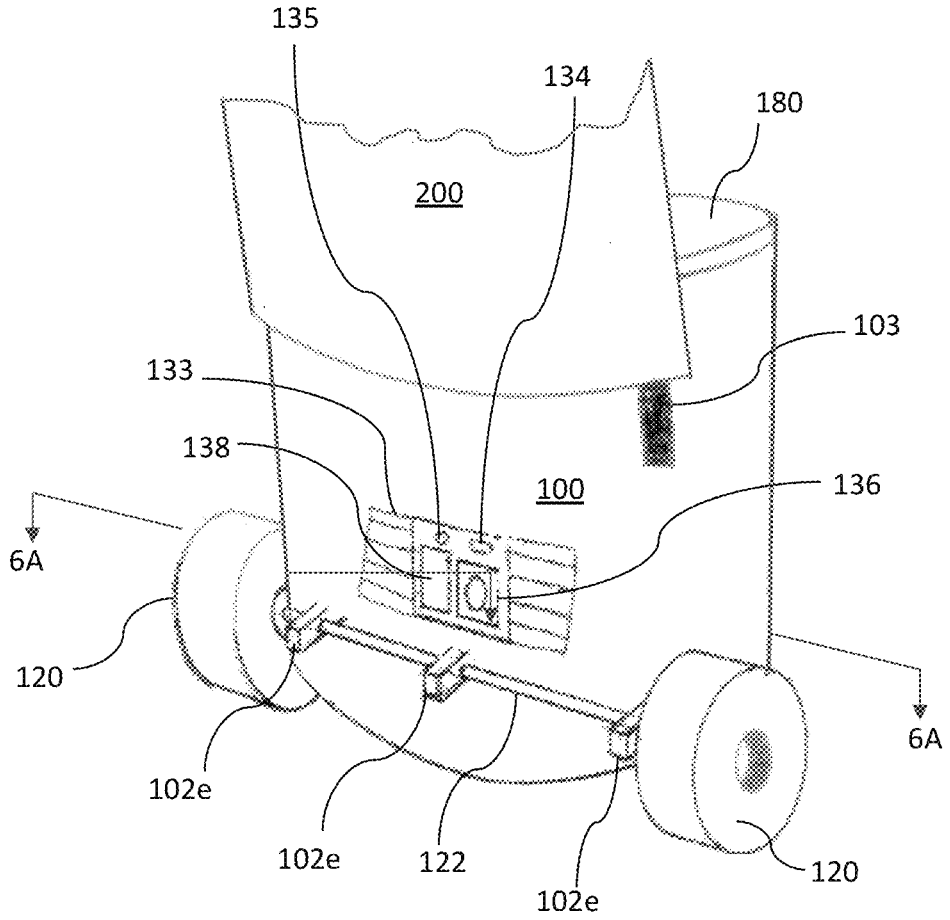
FIG. 5 is a rear perspective view of the seat cooler of FIG. 1 illustrating the position of the air intake assembly that includes intake vent 133 flanking AC adapter 135, rocket switch 134 for controlling fan 136 and battery 138 for powering fan 136.
Figure 6B:
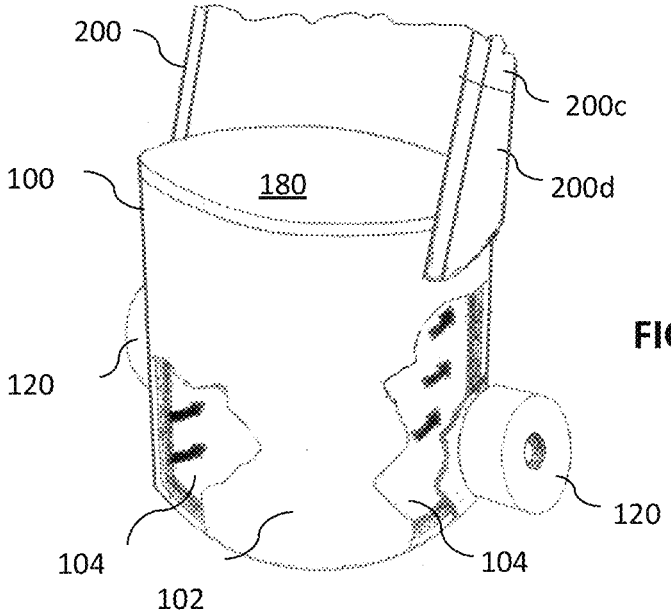

FIG. 5 provides a rear perspective view of cooler 100 in which a removable battery-powered air intake assembly is disposed at housing opening 130 above the wheel-axle assembly. The removable air intake assembly includes air intake vents 133 flanking a battery-fan electrical assembly for drawing air into an air space in the housing of cooler 100. The battery-fan electrical assembly includes fan 136, which blows external air into air space 101 within the housing of cooler 100 (see FIG. 3A-3B), rechargeable battery 138 for powering fan 136, AC adapter port 135 for charging the battery from a 120 volt AC household outlet adaptor (or a 12 volt DC automotive plugin adaptor), and fan on/off switch 134 for turning the fan on and off. The optional air intake assembly mounted at housing opening 130 draws exterior air through intake vents 133 on either side of fan 136 into air space 101 as illustrated in cross-sectional view taken at line 6A-6A of FIG. 5 (FIG. 6A, arrows indicate direction of air flow in air space 101). Air space 101 surrounds thermal insert 104 and can be cooled by the contents of chamber 107, for example, ice or the like in chamber 107 of cooler. External air enters air space 101 at opening right of partition 109 and flows in a counter clockwise direction around thermal insert 104 as indicated by the arrows in FIGS. 6A & 6B. FIG. 6B provides a front perspective view of cooling apparatus 1 in which a portion of outer shell 102 is cut out to illustrate airflow within air space 101. In these embodiments, housing opening 130 and thus the air intake assembly (represented by fan 136 and battery 138) are situated to the right of partition 109. In an alternative embodiment, in which housing opening 130 and thus the air intake assembly are situated to the left of partition 109 (not shown), external air enters air space 101 at opening left of partition 109 and flows in a clockwise direction around thermal insert 104.

Figure 7A:
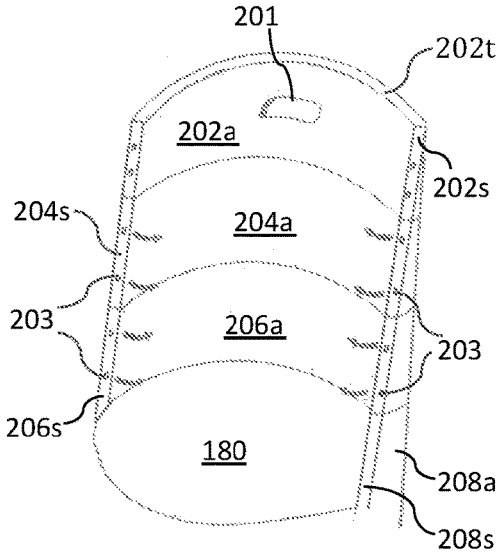
FIGS. 7A-7E are various views of telescopic backrest 200 including: a front perspective view showing the four sections 202, 204, 206, and 208 of the back rest, each with side openings 203 for the egress of air from air chamber 201 (7A); a front view showing various positions of telescopic backrest 200 as section 202 and section 204 are retracted into section 206 or fully extended as represented by the dotted lines (7B); an enlarged cross-sectional view of back rest 200 illustrating the triple-wall construction of backrest 200, which includes anterior panel 202*a*, inner panel 202*m* and posterior panel 202*p* forming anterior chamber 201 and posterior chamber 203 (7C); a posterior view of backrest 200 in which posterior panels 202*p*, 204*p*, 206*p* and 10 206*p* have been removed to illustrate the telescopic structure of structural ribbing 207 (7D, dashed lines indicated the wider portion of each segment); and a cross-sectional view of backrest 200 along line 7E-7E in which the sections are retracted and the backrest collapsed for stowing (7E).
Figure 7B:
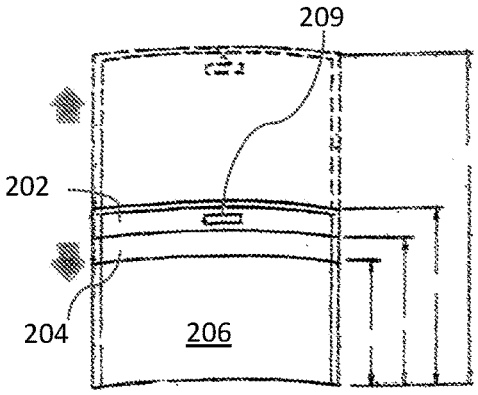
Figure 7C:
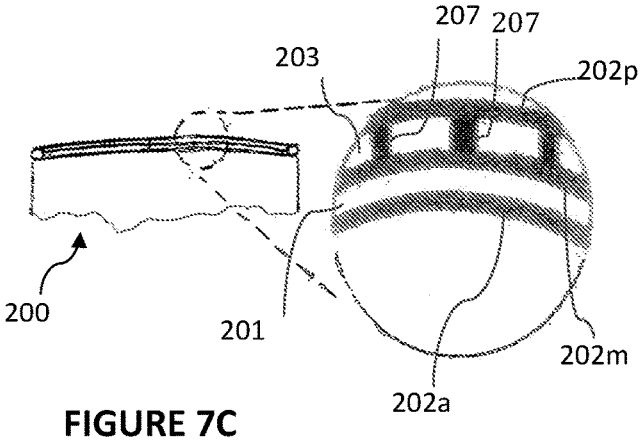

Telescopic backrest 200 of cooling apparatus 1 is illustrated in FIGS. 7A-7E. Backrest 200 includes similarly-shape sections 202, 204, 206 and 208 of triple wall construction and a curvature resembling the curvature of the lateral wall of the cooler (FIG. 7A). Sections 202, 204, 206 and 208 are progressively larger in size, each composed of an anterior panel (202*a*, 204*a*, 206*a* and 208*a*, respectively) having a concave outer surface adjoining a posterior panel (202*p*, 204*p*, 206*p* and 208*p*, respectively) having a convex outer surface through two side panels (202*s*, 204*s*, 206*s* and 208, respectively). Uppermost section 202 of backrest 200 also includes top panel 202*t* and lowermost section 208 includes bottom panel 208*b* (not shown). Each of backrest section 202, 204, 206 and 208 also includes inner panel 202*m*, 204*m*, 206*m* and 208*m*, respectively, disposed between the corresponding anterior and posterior panels to form anterior chamber 201 and posterior chamber 203 (FIG. 7C).

Figure 7D:
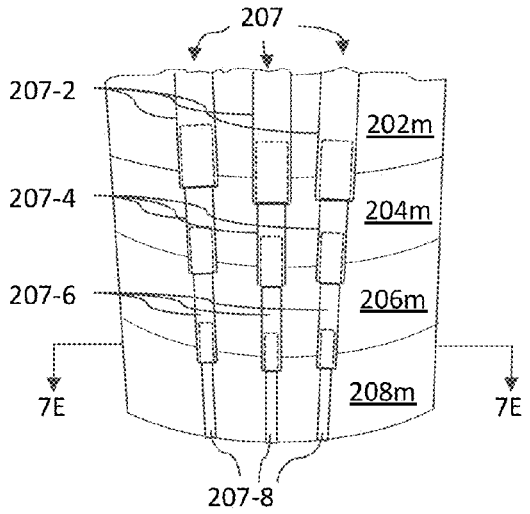
Figure 7E:
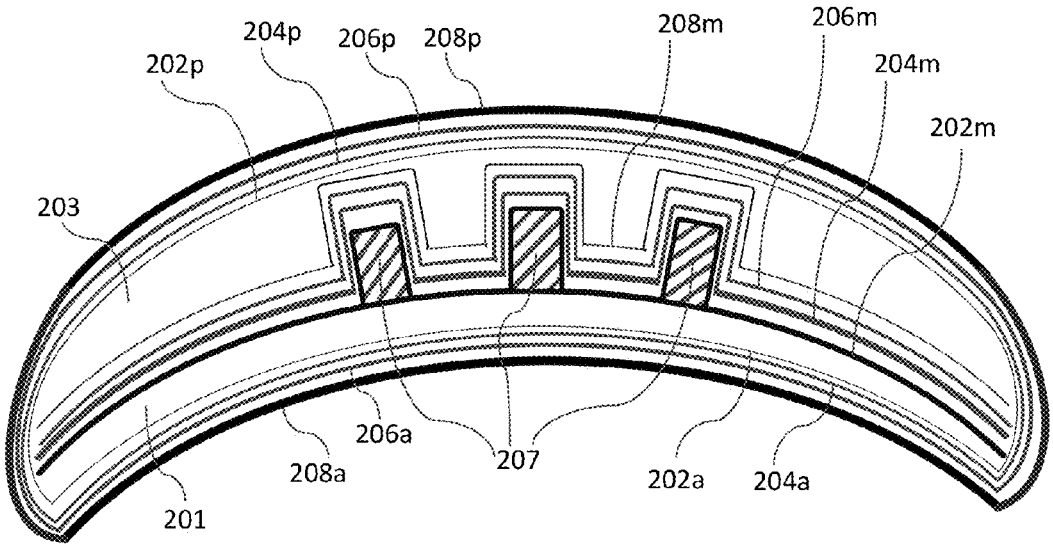

Anterior chamber 201 of backrest 200 receives cooled air from air space 101 of cooler 100 as further described below and illustrated in FIG. 8. Posterior chamber 203 accommodates telescopic structural ribbings 207 (FIG. 7C), which are attached to the posterior side of inner panels 202*m*, 204*m*, 206*m* and 208*m* and extends the length of backrest 200 for added strength and support as shown in FIG. 7D. FIG. 7D provides a posterior view of backrest 200 in which respective posterior panels have been removed and illustrates fully extended telescopic ribbing 207. Telescopic ribbing 207 includes ribbing section 207-2, 207-4, 207-6 and 207-8, each of which is attached to respective inner panel 202*m*, 204*m*, 206*m* and 208*m* and thus are extended upwardly or retracted downwardly as the inner panels are drawn upwardly or collapsed downwardly. FIG. 7E provides a cross-sectional view of collapsed backrest 200, i.e. in a stowed position, in which sections 202, 204, 206 and 208 are retracted one within the other in a nested fashion. Furthermore, as uppermost inner panel 202*m* is attached at its upper edge to top panel 202*t* of section 202, and lowermost inner panel 208*m* is attached at its bottom edge to bottom panel 208*b* of section 208, the inner panels and structural ribbings can be extended upwardly or collapsed downwardly when sections 202, 204, 206 and 208 are extended upwardly or collapsed downwardly, respectively, as illustrated in FIG. 7B. An enlarged cross-section of backrest 200 provided in FIG. 7C illustrates the triple wall construction of backrest 200 that includes anterior chamber 201 and posterior chamber 203 formed by anterior, inner and posterior panels of the backrest sections, as well as structural ribbings 207 within posterior chamber 203.

The interior cavities of the backrest sections are in communication with each other (FIG. 7E) and in communication with air space 101 of cooler 100 through opening 190 (FIG. 8B, 8C) to allowing cooled air from space 101 to flow upwardly into anterior chamber 201 and out through vents 203 as illustrated by the arrows in FIG. 8A. Opening 190 is formed by the alignment of openings on opposing and contacting surfaces of outer shell 102 and anterior panel 208*a* of backrest 200 (FIG. 8B). The openings on opposing and contacting surfaces align when backrest 200 is fully extended to form a passageway for the egress of air from air space 101 of cooler 100 into anterior chamber 201 of backrest 200 (FIGS. 8B). In these embodiments, the portions of outer shell 102 and anterior panel 208*a* that surround the openings are in contact as shown in FIG. 8B thereby minimizing air leakage to the exterior of the cooling apparatus. In alternative embodiments where a gap exists between outer shell 102 and anterior panel 208*a*, rigid or flexible ducting or gasketing 192 can be used at opening 190 as illustrated in FIG. 8C. A plurality of vents 203 are disposed on side panels 202*s*, 204*s*, 206*s* and 208*s* as shown in FIG. 7A thereby allowing the flow of cooled air from air space 101 of cooler 100 to chamber 201 of backrest 200 to the exterior space adjacent to backrest 200 to cool an individual seated on the cooling apparatus.

Backrest 200 also includes a telescopic mechanism for extending or collapsing the backrest, as well as for maintaining backrest sections in position when extended. Telescopic mechanisms are well known to those of skill in the art. Any telescopic mechanism known to those of skill in the art can be employed. Examples of telescopic mechanism that can be employed include, without limitation, those described in Moussatche et al., Reinforced Extruded Tubing for Telescopic Handle for Trolley-type Carry Case and Carry Case Incorporating Same, U.S. Pat. No. 8,646,584; A. W. Han, Telescopic Handle for Luggage Cart, US 20030038007; C. Chen, Locking Device for a Telescopic Handle of a Luggage Item with Wheels, U.S. Pat. No. 6,405,407; C. Kuo, Retractable Handle Assembly with Multiple Engaging Position for Wheeled Luggage, U.S. Pat. No. 6,484,362; M. Taisto, Locking Mechanism Between Telescopically Insertable Tubes, EP 1 039 149; F. Chang, Telescopic Handle for Luggage Carts, U.S. Pat. No. 5,367,743, E. Kazmark, Cart and Luggage Handle Assembly with a Push Button Actuator, U.S. Pat. No. 5,414,895; J. W. Warner, Extendable Handle Structure, U.S. Pat. No. 3,513,952; S. Ho, Luggage Handle Assembly, U.S. Pat. No. 5,500,981; F. Chang, Operating Device for a Telescopic Handle of a Luggage Cart, U.S. Pat. No. 6,081,967; C. Kuo, Push Button Device for Release Locking Mechanism, U.S. Pat. No. 6,170,122; and E. Kazmark, Portable Luggage Carrier with Telescoping Handle, U.S. Pat. No. 3,998,476, the contents of which are incorporated by reference in their entireties.

Backrest 200 can be placed in a stowed position by activating a lock-release push-button at handle 201, for example, and pressing downwardly on the sections to cause smaller sections to slide into the body cavities of adjacent larger sections as guided by internal structural ribbings 207 to rest on internal stops. Backrest 200 can be extended partially or fully as illustrated in FIG. 7C by actuating the lock-release push button on handle 201 and lifting the sections upwardly until one or more sections lock into place, for example, through structurally molded J channels. Thus, the anterior panel, posterior panel and side panels of each section, as well as the top and bottom panels of the uppermost and lowermost sections, respectively, form curved backrest sections that have hollow cavities for accommodating both the respective inner panels with attached structural ribbings, as well as the smaller backrest sections. The curved backrest sections form a backrest that can have a concavo-convex, convexo-concave or meniscus cross-section with progressively larger interior cavities to allow adjacent sections to be nested one within another so as to be extendable in a telescopic manner.

Cooler 100 of cooling apparatus 1 is also fitted with insulated lid 180 for closing access to cooler storage chamber 107. Insulated lid 180 is illustrated in FIGS. 9A-9C. FIG. 9A provides a side view lid 180 and FIG. 9C provides a view from the underside. Lid 180 includes top portion 182 with molded recessed handle 183 for easy placement and removal from cooler 100 and lower portion 184 configured to fit snugly into the top opening of cooler 100 thereby reducing cool air leakage from the storage chamber 107 of cooler 100. Lid 180 has a similarly insulated construction as the cooler compartment housing (i.e. standard double wall construction with closed cell insulating foam between walls) and functions as a lid to close access to cooler storage chamber 107. Lid 180 also cooperates with cooler compartment 100 to form a seat effective to support a person. Cushion 186 can be secured to top portion 182 of lid 180 to increase comfort for an individual seated on the cooling apparatus (FIG. 9B). Lid 180 can also cooperate with cooler portion 100 as well as backrest 200 to form a concave surface for stably transporting one or more items.

OTHER EMBODIMENTS OF THE INVENTION

While the invention has been described in conjunction with the detailed description, the foregoing description is intended to illustrate and not limit the scope of the invention, which is defined by the scope of the claims. Other aspects, advantages, and modifications are within the scope of the following claims.

The terms and expressions that have been employed are used as terms of description and not of limitation, and there is no intent in the use of such terms and expressions to exclude any equivalent of the features shown and described or portions thereof. Thus, it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. In addition, the invention has been described broadly and generically herein. Each of the narrower species and subgeneric groupings falling within the generic disclosure also form part of the invention.

As used herein and in the appended claims, the singular forms "a," "an," and "the" include plural reference unless the context clearly dictates otherwise. Under no circumstances may the patent application be interpreted to be limited to the specific examples or embodiments or methods specifically disclosed herein.

What is claimed is:

1. A cooling apparatus comprising an insulated cooler having a storage chamber accessible through a top opening fitted with a similarly insulated lid that when closed forms a seat for a person, the cooler being coupled to a vented backrest that extends upward from a portion of the insulated cooler so as to provide back support for a person sitting on the cooler, wherein:

(a) the insulated cooler comprising an outer shell, an inner thermal insert and a first air space therebetween, the vented backrest comprising an anterior panel adjoining a posterior panel through side panels to form a second air space therebetween, the first air space and second air space being in communication to enable airflow therebetween;

(b) the cooling apparatus further comprises a first opening in the outer shell of the insulated cooler for airflow between the exterior of the cooler and the first air space, and one or more vents in the vented backrest for air flow between the second air space and the exterior of the apparatus.

2. The cooling apparatus of claim 1, further comprising a cover plate configured to fit at the first opening to close access thereof.

3. The cooling apparatus of claim 1, wherein the outer shell and inner thermal insert form a cooler housing that comprises a bottom and lateral wall, the bottom having a curved peripheral edge from which the lateral wall extends upwardly to form the storage chamber.

4. The cooling apparatus of claim 1, wherein the lid comprises a cushion on which a person can be seated.

5. The cooling apparatus of claim 1, further comprising an exterior wheel-axle assembly affixed to the cooler at a lower posterior position to enable towing of the cooling apparatus, and wherein the backrest comprises an integrated towing handle for towing the apparatus.

6. The cooling apparatus of claim 5, wherein the wheel-axle assembly comprises two wheels affixed at an elevated position relative to the bottom of the cooler so as to be positioned above the surface on which the bottom of the cooler rests and contacts the surface when the apparatus is tilted posteriorly.

7. The cooling apparatus of claim 1, wherein the outer shell of the cooler housing comprises closed cell foam insulation disposed between an outer wall panel and an inner wall panel.

8. The cooling apparatus of claim 1, wherein the outer wall panel, inner wall panel, or both outer and inner wall panels comprise stainless steel, polyethylene, polypropylene, polystyrene or any combination thereof.

9. The cooling apparatus of claim 1, wherein the inner thermal insert comprises a metal or a thermally conductive plastic.

10. The cooling apparatus of claim 1, wherein airflow between the first and second air spaces occurs through openings on the opposing surfaces of the outer shell of the cooler and anterior panel of the backrest that are in alignment, and wherein portions of the opposing surfaces that comprise the openings are in direct contact.

11. The cooling apparatus of claim 1, wherein airflow between the first and second air spaces occurs through openings in the cooler housing and backrest that comprise a rigid or flexible duct or gasketing material.

12. The cooling apparatus of claim 1, wherein the backrest comprises two or more telescopic sections that are retractable one within another to enable the backrest to be collapsed for stowing or extendable to form a back support for a person seated on the cooler.

13. The cooling apparatus of claim 12, wherein the sections are reinforced using one or more internal structural ribbings, each of which comprising two or more telescopic segments that can be collapsed or extended to collapse or extend the backrest.

14. The cooling apparatus of claim 1, wherein the backrest and cooler are integrally molded.

15. The cooling apparatus of claim 1, wherein the one or more vents are disposed in the anterior panel, side panels or both for the egress of air from the second air space to the exterior of the apparatus.

16. The cooling apparatus of claim 1, further comprising an air intake assembly disposed at the first opening for drawing air from the exterior of the cooler to the first air space, the air intake assembly comprising a fan for blowing air into the first air space, a power source for supplying power to the fan, and a switch for controlling power to the fan, wherein the fan, power source and switch are electrically connected so as to allow the switch to control power to the fan thereby allowing the fan to be turned on or off using the switch.

17. The cooling apparatus of claim 16, wherein the power source is a rechargeable battery.

18. The cooling apparatus of claim 17, wherein the air intake assembly further comprises an AC adapter port electrically connected to the rechargeable battery so as to enable the battery to be charged.

19. The cooling apparatus of claim 16, wherein the air intake assembly further comprises a 12 V DC automotive plugin adapter.

20. The cooling apparatus of claim 1, wherein the first air space and second air space are in communication through alignment of an opening in the outer shell of the insulated cooler with an opening in the anterior panel of the backrest thereby enabling airflow between the first and second air space.

21. The cooling apparatus of claim 20, wherein the aligned openings in the outer shell and anterior panel of the backrest comprise a rigid or flexible duct or gasketing material.

22. The cooling apparatus of claim 1, wherein the outer shell of the insulated cooler and the posterior panel of the backrest are integrally molded to form a continuous structure, and the anterior panel of the backrest extends downwardly terminating in a lip disposed in overlapping configuration with a peripheral flange of the thermal insert, the first air space thereby being continuous with the second air space.

23. A cooling apparatus comprising an insulated cooler coupled to a vented backrest, wherein:

(a) the insulated cooler comprises an outer shell, an inner thermal insert and a first air space therebetween, the vented backrest comprises an anterior panel adjoining a posterior panel through side panels to form a second air space therebetween, the first air space and second air space being in communication to enable airflow therebetween;

(b) the cooling apparatus further comprises a first opening in the outer shell of the insulated cooler for airflow between the exterior of the cooler and the first air space, and one or more vents in the vented backrest for air flow between the second air space and the exterior of the apparatus; and (c) airflow between the first and second air spaces occurs through openings on the opposing surfaces of the outer shell of the cooler and anterior panel of the backrest that are in alignment, wherein portions of the opposing surfaces that comprise the openings are in direct contact.

* * * * *